US007484472B1

(12) United States Patent
Highfield

(10) Patent No.: US 7,484,472 B1
(45) Date of Patent: Feb. 3, 2009

(54) RETRACTABLE PONTOON BOAT COVER

(76) Inventor: John Highfield, 3577 N. West Branch Dr., Gladwin, MI (US) 48624

( * ) Notice: Subject to any disclaimer, the term of this patent is extended or adjusted under 35 U.S.C. 154(b) by 0 days.

(21) Appl. No.: 11/805,385

(22) Filed: May 22, 2007

Related U.S. Application Data

(60) Provisional application No. 60/797,350, filed on May 26, 2006.

(51) Int. Cl.
*B63B 17/00* (2006.01)

(52) U.S. Cl. ..... 114/361

(58) Field of Classification Search ..... 114/361
See application file for complete search history.

(56) References Cited

U.S. PATENT DOCUMENTS 4,091,484 A * 5/1978 Means ..... 114/361
4,979,456 A * 12/1990 Steward ..... 114/351
6,209,477 B1 * 4/2001 Biedenweg ..... 114/361
6,260,505 B1 * 7/2001 Polidan ..... 114/361
6,588,361 B2 7/2003 Biedenweg
7,249,568 B1 * 7/2007 Cultrara ..... 114/361
2002/0053313 A1 * 5/2002 Murphy et al. ..... 114/361

* cited by examiner

*Primary Examiner*—Stephen Avila

(57) ABSTRACT

A cover system for a pontoon boat having an expanding frame. The cover system includes framework for receiving a flexible material thereon. The framework has a plurality of U shaped supports that have the ability to traverse on a track apparatus for the purpose of quick and easy placement and removal. The cover system also includes a stowing compartment for the specific purpose of storage of framework and cover components therein.

4 Claims, 8 Drawing Sheets

RETRACTABLE PONTOON BOAT COVER

CROSS-REFERENCE TO RELATED APPLICATIONS

This application claims the benefit of provisional application Ser. No. US 60/797,350, filed 2006 May 26 by the present inventor.

FEDERALLY SPONSORED RESEARCH

Not Applicable

SEQUENCE LISTING OR PROGRAM

Not Applicable

BACKGROUND OF THE INVENTION

1. Field of the Invention

The present invention relates to a covering system for a pontoon boat, and, more specifically, to a manually operated, expanding frame system which allows for quick and easy placement and removal of the boat cover.

2. Description of the Prior Art

It is well known to provide a boat with a cover to prevent water and other debris from collecting inside the boat when the boat is not in use. In many instances, boats utilize covers designed to be affixed to the boat via a plurality of snaps. Typically, a plurality of male snap members are affixed to the outboard side of the boat, while a plurality of female snap members are affixed to the boat cover. The snap members are spaced about the entire perimeter of the cover to effect affixation thereof. For example, pontoon boats typically include a plurality of male snap members affixed to the outboard side of the rails forming the perimeter fencing of the pontoon boat.

Covers of this type (i.e., covers affixed by snaps) are relatively difficult to place in operative position. Many times the snap members are difficult to join together as well as to release. Additionally, the boat cover may shrink based upon climatic conditions. In these situations, the cover must be stretched for positioning about the boat since the snap members have a fixed spacing about the boat and the cover. Additionally, if the cover shrinks when affixed to the boat, removal will be made more difficult since the shrinking of the cover will exert forces on the snap connectors, which forces will generally be normal to the direction in which the snap connectors release.

Furthermore, it becomes necessary that the removed cover material is manually organized and placed into a storage compartment. Typically, the storage compartment is located beneath a seat cushion within the interior of the boat. Many times the storage compartment is smaller in size than the cover material. The cover material then has to be forcibly deposited inside. The same inconvenience is present while removing the cover from the storage compartment. In addition, reinstallation of the cover onto the boat is difficult and extremely time consuming.

With the above disadvantages of the snap cover in mind, various alternative systems have been proposed. These systems include those utilizing cooperative pairs of hooks. In these embodiments, one of a pair of cooperative hooks is affixed to the boat cover, while the second of the pair of cooperative hooks is affixed to an outboard facing portion of the boat. The hooks are oppositely oriented so that, in use, each hook "hooks" the other such that each hook end is positioned internally in the body of the opposing hook. The vertical orientation of the hooks of this connecting mechanism necessitate tension in the cover to maintain engagement of the hooks. In these fastener arrangements, a portion of the boat cover extends past the hook affixed thereto and provides a gripping location for detachment of the cooperating hooks. To disengage the cooperating hooks and thereby disengage this cover affixing mechanism, the cover must be pulled downwardly so that the hook ends are displaced, one relative to the other. Pulling the cover downwardly to disengage this cover affixing mechanism is particularly difficult, e.g., when the cover has shrunk due to climatic conditions and/or rainwater has pooled on the cover. In both of these situations (i.e., cover shrinkage, or pooling of rainwater), a force acts on the boat cover opposite to the direction of displacement required to disengage the cooperating hooks.

What is needed in the art is a boat covering system which allows for quick and easy placement and removal of a boat cover and which does not suffer from the disadvantages of the prior art outlined above.

SUMMARY OF THE INVENTION

It is the intent of the present invention to address the aforementioned concerns. The present invention provides an improved covering system wherein it is desired to provide a boat covering system which allows for quick and easy placement and removal of the boat cover and does not require stretching of the boat cover to remove same. The current cover system comprises an expanding frame system attachable to both sides of the boat, utilizing a track apparatus fastened horizontally to both sides of the boats deck. The frame system includes a plurality of U shaped support members constructed of square, round, or rectangular tubes designed to span the width of the boat, with arched formations at the top of each. The support members are interconnected by the fabric cover material. The U shaped supports are inserted into pockets constructed into the fabric material equally spaced about; creating an expandable connection between U shaped supports. The first U shaped support is manually advanced by means of the track apparatus causing extension of the fabric between it and the following U shaped support. When the extension of the fabric is complete the following U shaped support advances. Each connected section follows systematically until full extension of framework and cover material is achieved. The U shaped support members maintain a horizontal position in relation to the track apparatus, with exception to the rear U shaped support. The rear U shaped support and the U shaped support preceding it have a pivoting connection at their base to effect a downwardly pivoting motion by the rear U shaped support to complete extension of covering system, and an upward pivoting motion by the rear U shaped support to begin retraction of covering system. The upward pivoting motion is begun utilizing a pull cord assembly comprising: a cable attachment from the rear U shaped support to a pulley system mounted on the interior of the preceding U shaped support. The upward pivoting commences by exerting a generally downward pressure to the handle of the pull cord assembly thereby inciting an upward pivoting motion to the rear U shaped support. The U shaped support members with exception to rear U shaped support have directional movement devices attached at the base, thereby connecting the frame system to the track apparatus. The directional movement device comprising a C shaped bearing block that provides a linear moveable connection on the track apparatus to effect the linear motion required to advance the U shaped support members, the bearing block also consists of a solid tubular elongate member permanently fixed to the top, situated vertically, functioning as a connection unit joining the directional movement device to the U shaped support. The U shaped support constructed of hollow tubing is mounted onto the solid tubular elongate member. The rear U shaped support is equipped with a retainer mechanism fixed in a perpendicular direction at its base. As the rear U shaped support pivots downward to complete expansion the retainer mechanism engages the end of the track apparatus causing entire covering system to be set in place. The rear U shaped support extends a distance beyond the rear of the deck of the boat to cover any outboard motor. To retract the covering system, the process is reversed. A generally downward pressure is applied to the handle of the pull cord assembly disengaging the retainer mechanisms, allowing the rear U shaped support to pivot upward until it is aligned adjacently to the preceding U shaped support. The frame system then retracts forward utilizing the track apparatus. When full retraction is achieved the frame and all components thereof are compressed together at the front of the track apparatus. The weight of the expanding frame and attached fabric causes the front end of the track apparatus, which is connected to a weight balance control mechanism, to pivot forward and deposit entire cover system into a U shaped stowing compartment mounted around the front of the boat. The U shaped stowing compartment has a hinged lid which then closes to fully conceal the contents inside.

An advantage of the present invention is the ability to provide a boat covering system which allows for quick and easy application and removal.

Another advantage of the present invention is to provide a boat covering system which does not require the boat cover to be stretched due to the removal of all snapping mechanisms.

Finally, the most attractive advantage of the present invention is the reduced time of placement and removal.

BRIEF DESCRIPTION OF THE DRAWINGS

The above mentioned and other features and advantages of this invention, and the manor of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manor.

DESCRIPTION OF THE PREFERRED EMBODIMENT

Figure 1:
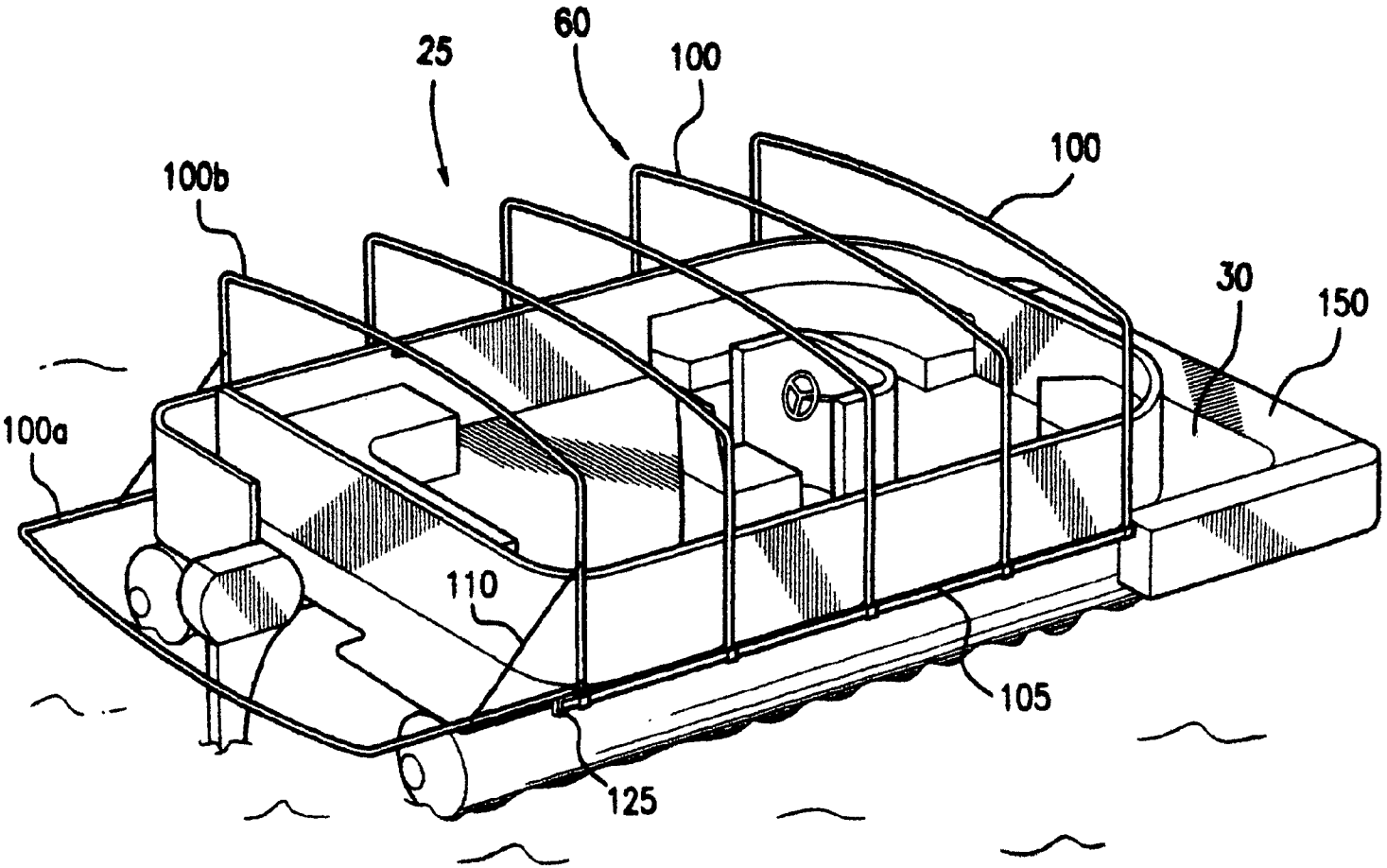
FIG. 1 is a perspective view of a pontoon boat, showing "U" shaped cover supports in the fully erect position, with stowing compartment closed.

Looking at FIG. 1 there is shown, a typical pontoon boat 25. A pontoon boat includes a flat floor surface often referred to as a deck 30.

A cover system is provided in the present invention that includes a frame system 60 adaptable for receiving a flexible or fabric material (not shown) thereon and attached to the frame system 60 by conventional methods. The frame system 60 includes a plurality of "U" shaped tubular elongate members 100 spaced at equal distances, spanning the width of the boat Each "U" shaped tubular elongate member 100 has an arched formation at the top designed to raise the central portion of the boat cover so that precipitation will tend to be directed away from the center of the boat 25. Connected at the base on each side of the "U" shaped tubular elongate members 100 is a "C" shaped bearing block 120. The "C" shaped bearing block 120 has a solid tubular elongate member 121 extending from its top. This solid tubular elongate member 121 is inserted into the "U" shaped tubular elongate member 100 at its base. This connection between the "U" shaped tubular elongate member 100 and the "C" shaped bearing block 120 allows the frame system to traverse by means of the track apparatus 105. The track apparatus 105 is connected to the side of the boat deck 30 by means of a solid elongate spacer 144. The track apparatus 105 and the solid elongate spacer 144 span almost the length of the boat deck 30, on each side situated parallel to each other. The track apparatus 105, allows the frame system 60 to extend and retract. As shown in FIG. 1 the frame system 60 is illustrated in the extended position.

Figure 2:
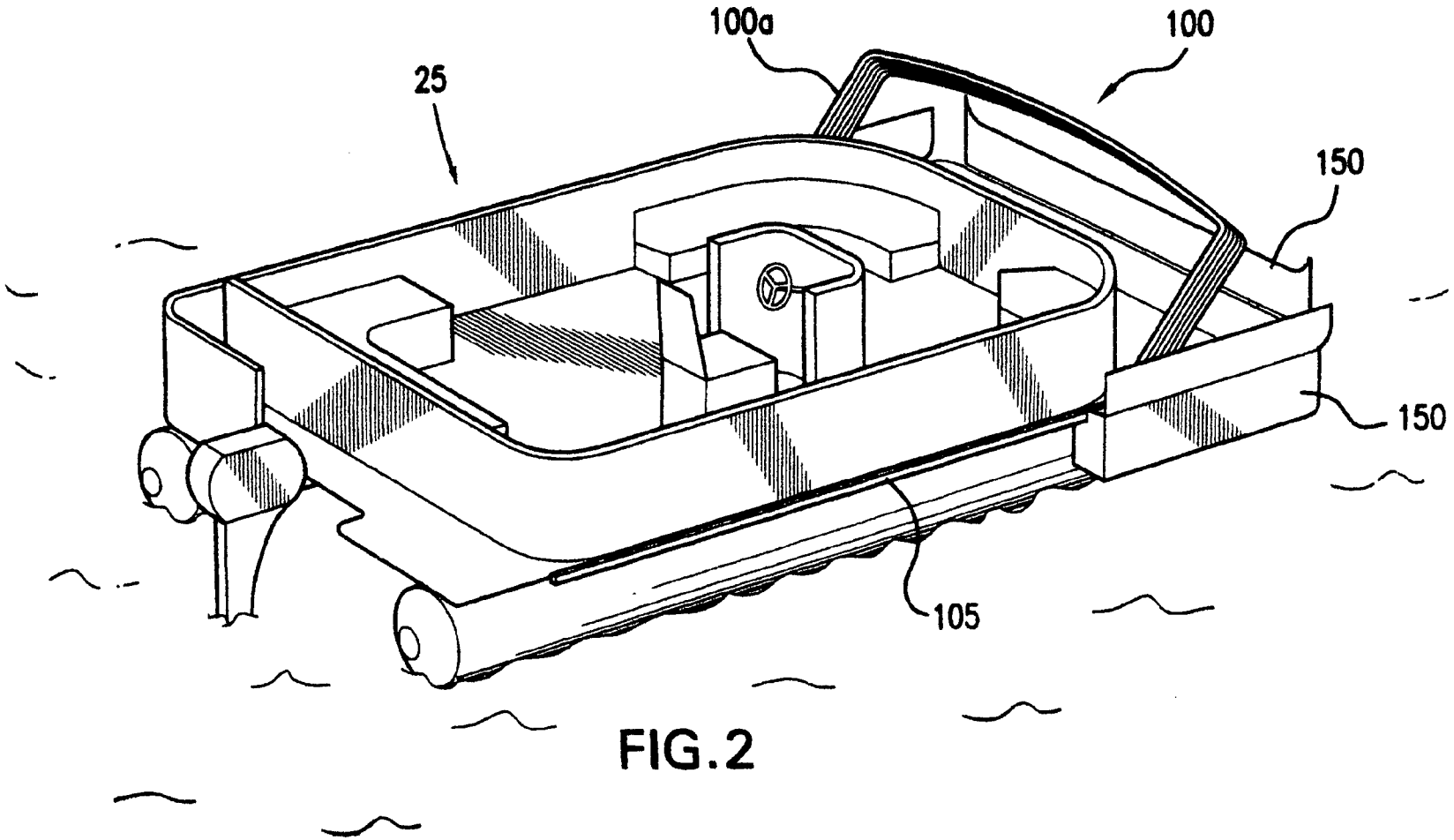
FIG. 2 is a perspective view of a pontoon boat, showing "U" shaped cover supports grouped together descending into an opened stowing compartment.

Turning now to FIG. 2, the "U" shaped tubular elongate members 100 are grouped together, descending into the stowing compartment 150. Notice the stowing compartment is in the opened position.

Figure 3:
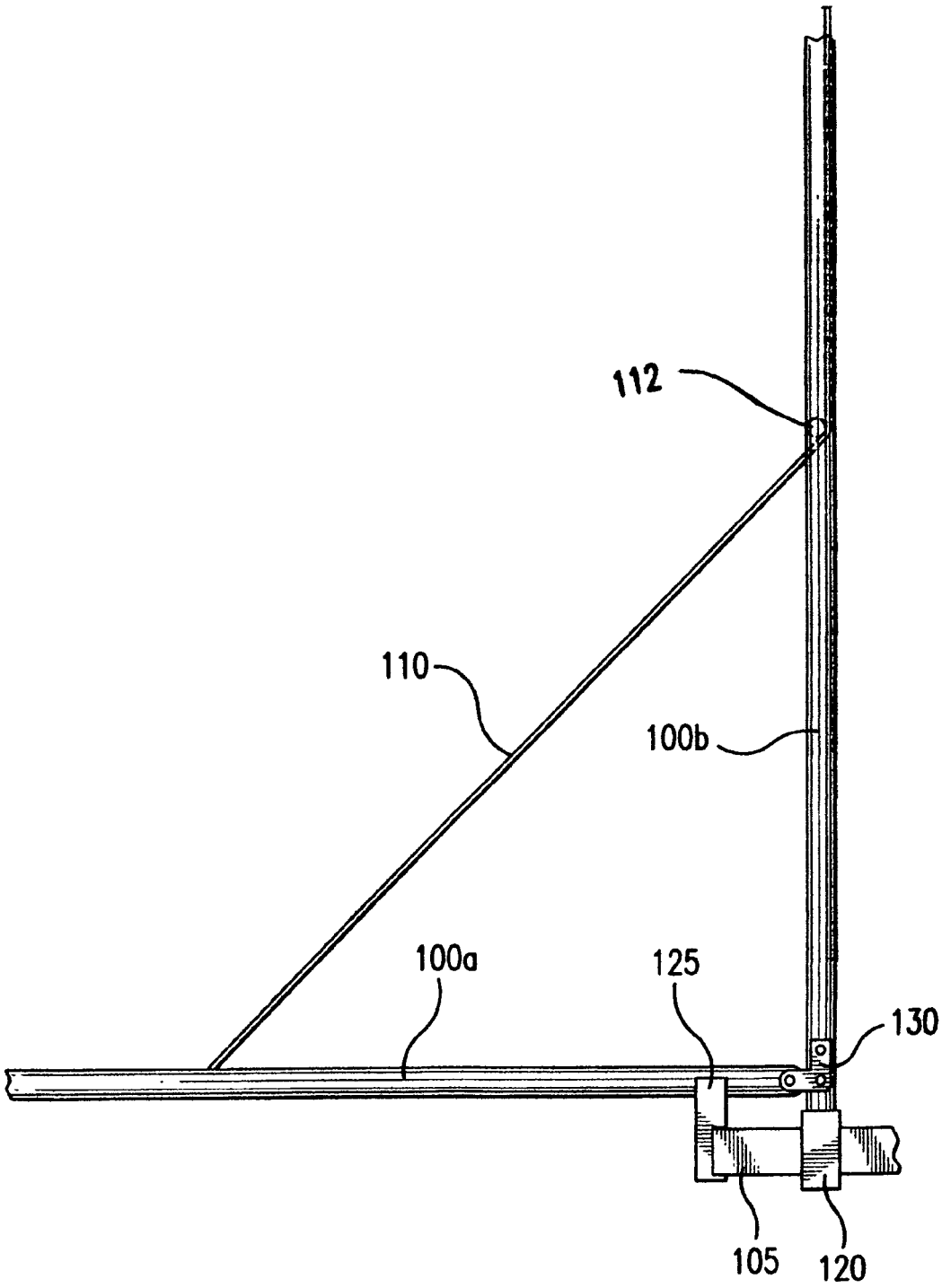
FIG. 3 is a detailed side view of the rear most pair of "U" shaped support members, showing pull cord assembly, pivoting means, retainer clip engaged, bearing block on track apparatus, and rear "U" shaped support member in the horizontal position.
Figure 4:
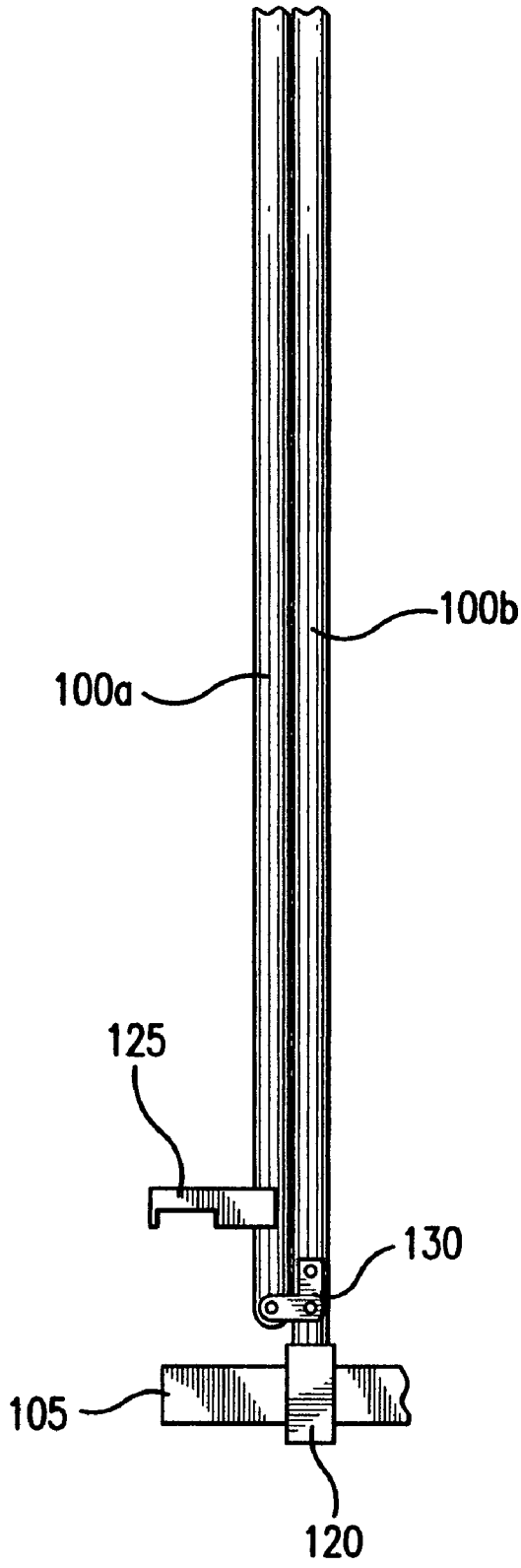
FIG. 4 is a detailed side view of the rear most pair of "U" shaped support members, showing retainer clip disengaged, and the rear "U" shaped support member in the vertical position.

Referring now to FIGS. 3 and 4. In FIG. 3 a portion of the track apparatus 105 is illustrated showing the rear "U" shaped tubular elongate member **100*a* in the horizontal position. The rear "U" shaped tubular elongate member 100*a* has a pivoting connection to the preceding "U" shaped tubular elongate member 100*b*by means of the pivot hinge 130. The rear "U" shaped tubular elongate member 100*a* is connected to the retainer clip 125. The retainer clip 125 engages the end of the track apparatus 105 to complete extension of the frame system 60**.

FIG. 4 shows the same portion of the track apparatus 105 illustrating the rear "U" shaped tubular elongate member **100*a*** in the vertical position with the retainer clip disengaged.

Figure 5:
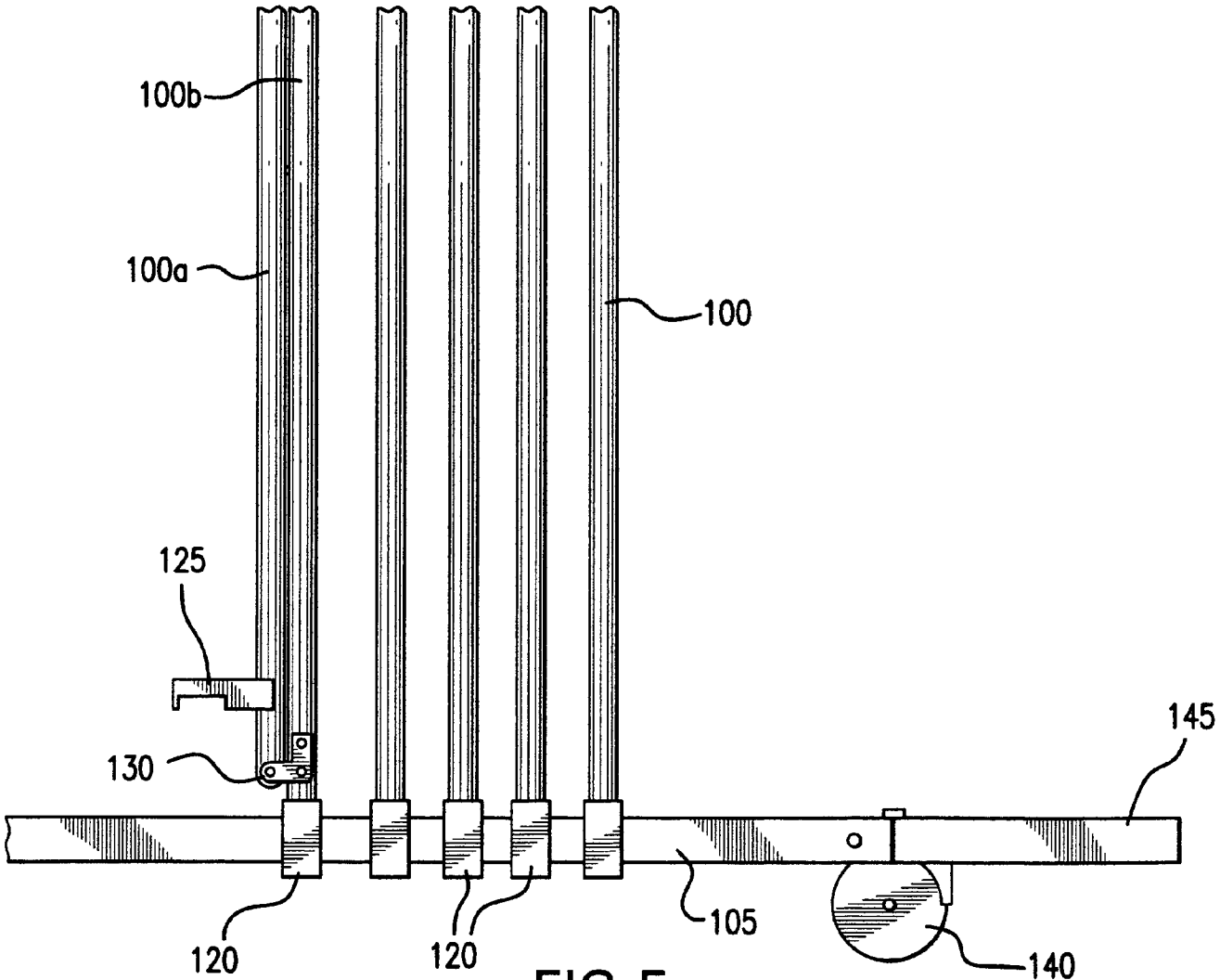
FIG. 5 is a side view of track and pivot track aligned along their axes, showing pivot spring and series of "U" shaped support members traversing track.

FIG. 5 illustrates the "U" shaped tubular elongate members 100 traversing the track apparatus 105 to the front pivot track 145, by means of the bearing blocks 120.

Figure 6:
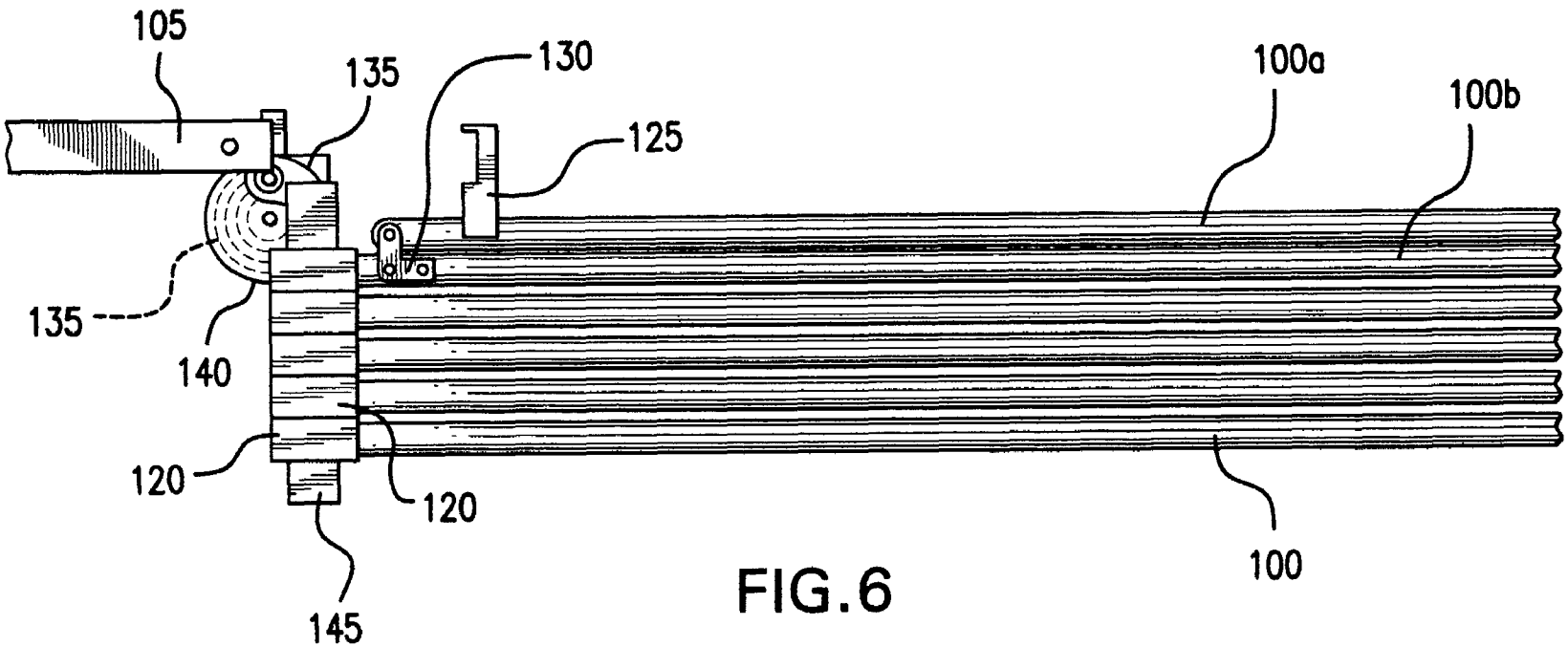
FIG. 6 is a detail of the track, pivot spring, and front pivot track with "U" shaped support members grouped together in the horizontal position and stowed away.

FIG. 6 illustrates the "U" shaped tubular elongate members grouped together at the front of the front pivot track 145 in the horizontal or "pivoted" position. The pivot spring housing 140 causes the front pivot track 145 to traverse, when a generally downward force is applied to the "U" shaped tubular elongate members 100 they descend into the stowing compartment 150. The counter balance spring 135, located in the interior of the of the pivot spring housing 140, maintains the frame system 60 in a weightless condition while pivoting occurs.

Figure 7:
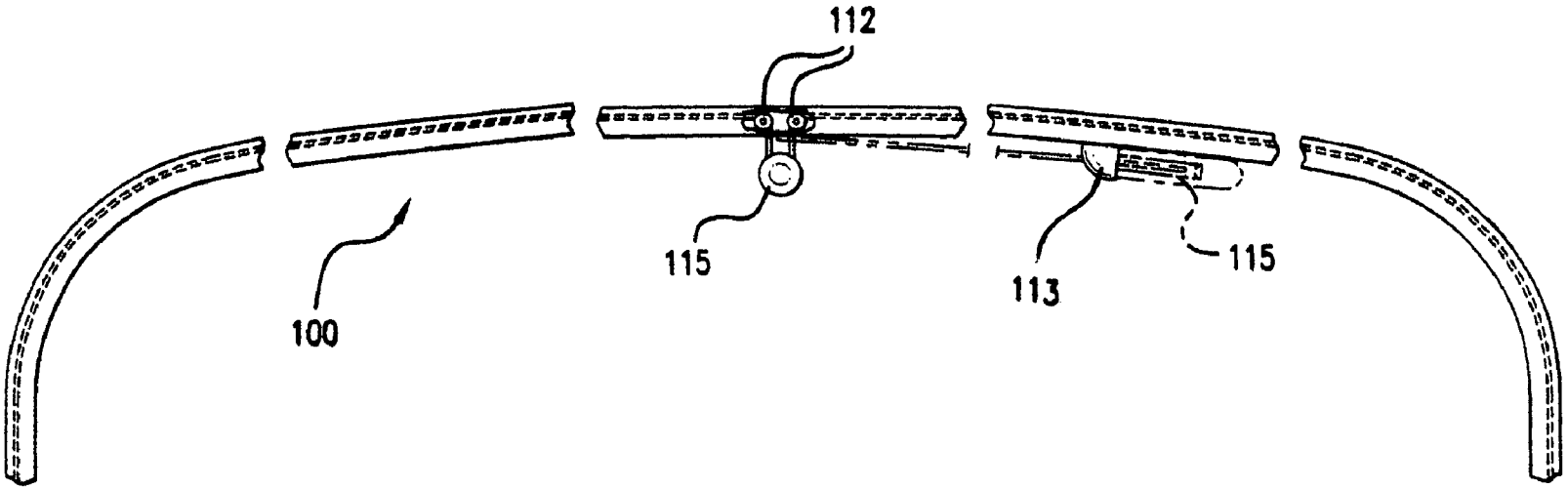
FIG. 7 is a front view of a "U" shaped support member with the pull cord handle in the retainer and also shown in an alternative position.

Looking at FIG. 7 there is the pull cord handle 115 connected to the pull cord 110. The pull cords 110 traverse from the pull cord handle 115 into the interior of the "U" shaped tubular elongate member 100*b*. The pull cords are redirected from a vertical position to a horizontal position by a set of bearings 112 inside of the "U" shaped tubular elongate member 100*b*. The pull cords 110 traverse down each side of the "U" shaped tubular elongate member 100*b* until reaching exit bearings 112 which redirects the pull cords 110 to exit the interior of the "U" shaped tubular elongate member 100*b*. The pull cords 110 are affixed to the rear "U" shaped tubular elongate member 100*a*. When a generally downward pressure is applied to the pull cord handle 115 it creates tension on the pull cords 110 causing the rear "U" shaped tubular elongate member 100*a* to pivot from a horizontal position to a vertical position until adjacent to the preceding "U" shaped tubular elongate member 100*b*. Also, disengaging the retainer clip 125, placing the frame system 60 into the retractable position. When the frame system 60 is in the retractable position, the pull cord handle is stowed away in the pull cord handle retainer 113.

Figure 8:
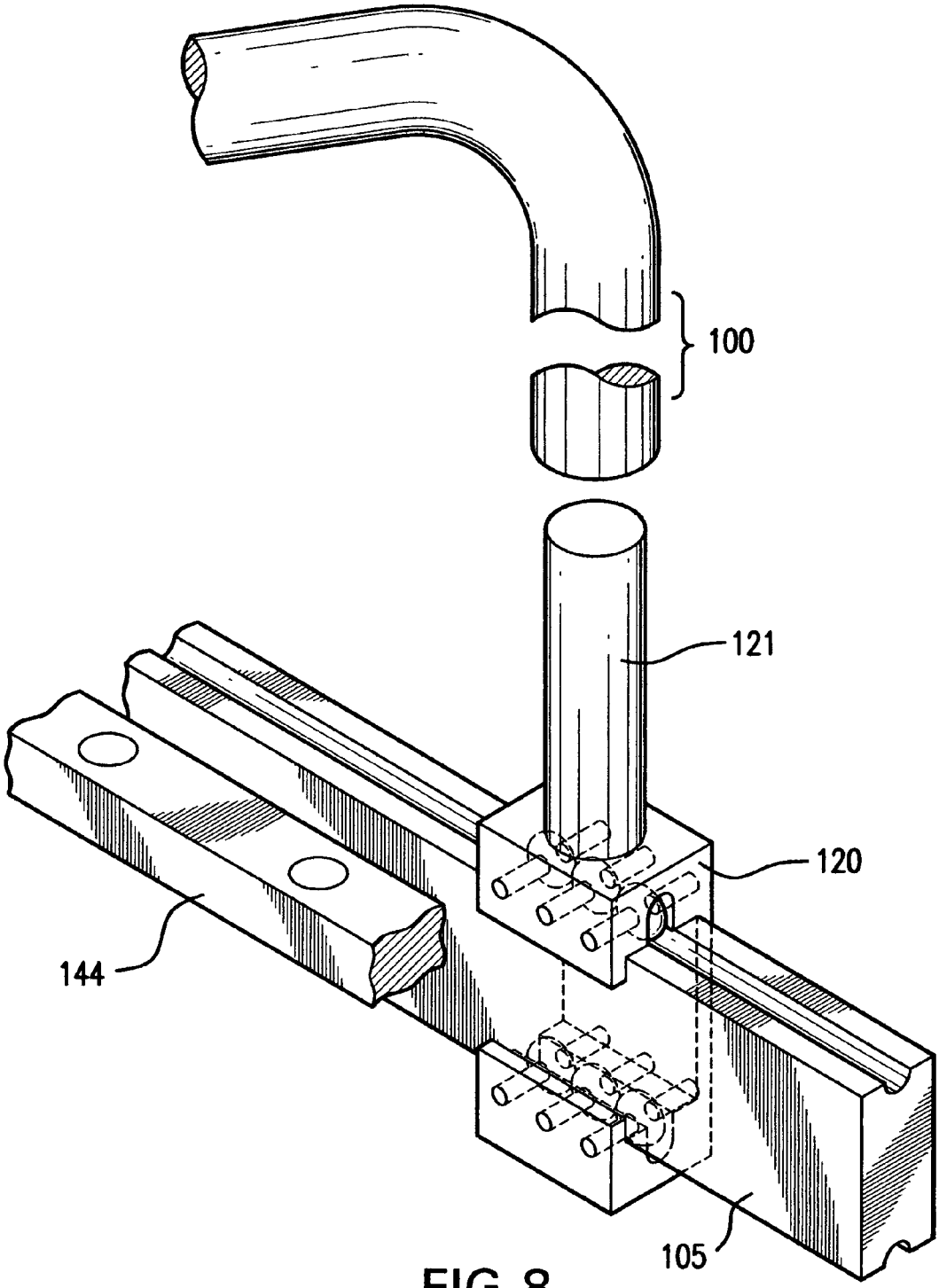
FIG. 8 is a three dimensional, detailed view of the bearing block on the track, revealing interior bearings resulting on the track, exploded track spacer and end of "U" shaped support member.

FIG. 8 illustrates bearing block 120 traversing the track apparatus 105 with spacer 144 present. While this invention has been described as having a preferred design, the present invention can be further modified within the spirit and scope of this disclosure. This application is therefore intended to cover any variation, uses, or adaptations of the invention using its general principals. Further, this application is intended to cover such departures from the present disclosure as come within known or customary practice in the art to which this invention pertains and which fall within the limits of the appended claims.

I claim:

1. A cover system for a typical pontoon boat said cover system comprising:

an expanding frame that extends and retracts over and around the deck of said pontoon boat in a manor which when fully extended said expanding frame is fully encompassing said boat deck and all improvements thereon, said expanding frame system having a number of U shaped supports, each said U shaped support is constructed from a single, formed elongate member, and is vertically aligned, at equal distances, including at the base of each, with exception to the rear said U shaped support a device that causes directional movement, said directional movement devices are mounted on an elongated guide apparatus, specifically constructed as a means of traversing the U shaped supports, fastened horizontally on each side of said boats deck situated parallel to each other, whereby allowing said expanding frame to extend and retract when manually manipulated, the rear said U shaped support is directly pivoted to the said U shaped support directly preceding it and is equipped with a latch mechanism to effect expanding frame into a locking position, when said expanding frame is fully retracted it causes the front portion of said elongated guide apparatus to pivot forward placing all frame components into a stowing compartment attachably fixed around the front of said pontoon boat deck, said stowing compartment is a complete and separate entity of itself with an attachable connection to the front of the said boat, said stowing compartment has a U shaped design and has an attachable connection to the said front of the said boat, and also to the front portion of the two sides of the said boat, said stowing compartment in reserved as storage for said expanding frame and said frame components thereof.

2. The cover system of claim 1 wherein said rear U shaped supports directional movement is dependent upon a pivot able connection at the base of the U shaped support preceding it.

3. The cover system of claim 1 wherein said expanding frame is designed to receive a flexible fabric cover, said flexible fabric cover is form fitted to the dimensions of the expanding frame when expanded.

4. The method of covering a pontoon boat using an expanding frame system, comprising:

(a) providing a covering system of the type comprising said expanding frame that extends and retracts over and around the deck of said pontoon boat in a manner which when fully extended said expanding frame is fully encompassing said boat deck and all improvements thereon, said expanding frame system having a number of said U shaped supports vertically aligned, including at the base of each, with exception to the front and rear U shaped support, a device that causes directional movement, said directional movement devices are mounted on an elongated guide apparatus fastened horizontally on each side of said boat deck situated parallel to each other, whereby allowing said expanding frame to external and retract when manually manipulated, when said expanding frame is fully retracted it causes the front portion of said elongated guide apparatus to pivot forward placing all frame components into a said stowing compartment fixed around the front of said pontoon boat deck;

(b) providing a typical said pontoon boat having at least two said flotation units with a said deck attached thereon and installing said stowing compartment containing said expanding frame covering system, also installing said elongated guide apparatus on both sides of the pontoon boats deck;

(c) opening the lid of said stowing compartment and pivoting said expanding frame upward out of said stowing compartment, extending said expanding frame by means of said directional movement devices, with said directional movement devices mobility dependent on said elongated guide apparatus, once said expanding frame has reached the limit of expansion said rear U shaped support pivots downward until parallel with said boat deck;

(d) reversing the above process will retract said pontoon boat cover system, by pivoting said rear U shaped support upward until adjacent with preceding said U shaped support, retracting said expanding frame by means of said directional movement devices with said directional movement devices mobility dependent on said elongated guide apparatus until said expanding frame is fully retracted, then pivoting downward to deposit said expanding frame and said fabric cover material into said stowing compartment then placing said lid to conceal contents.

* * * * *